US006422625B1

(12) United States Patent
Van Der Laan

(10) Patent No.: US 6,422,625 B1
(45) Date of Patent: Jul. 23, 2002

(54) REMOTE OPERATED LIFTING HOOK

(75) Inventor: Markus Van Der Laan, Oegstgeest (NL)

(73) Assignee: IMC Group B.V., Rotterdam (NL)

( * ) Notice: Subject to any disclaimer, the term of this patent is extended or adjusted under 35 U.S.C. 154(b) by 0 days.

(21) Appl. No.: 09/391,509

(22) Filed: Sep. 8, 1999

(30) Foreign Application Priority Data

Sep. 8, 1998 (NL) ..... 1010035

(51) Int. Cl.[7] ..... B66C 1/34

(52) U.S. Cl. ..... 294/82.11; 294/82.1; 294/82.19; 294/82.23

(58) Field of Search ..... 294/19.1, 66.1, 294/75, 82.1, 882.11, 2.17, 82.19, 82.24, 82.25, 82.27, 82.31–82.36, 74

(56) References Cited

U.S. PATENT DOCUMENTS 894,345 A * 7/1908 Raymond ..... 294/82.27
1,025,353 A * 5/1912 White ..... 294/82.1
1,333,511 A * 3/1920 Small ..... 294/82.33
2,341,876 A * 2/1944 Masterson ..... 294/82.33
3,038,753 A * 6/1962 Seager ..... 294/82.33
3,383,721 A * 5/1968 Adams ..... 294/74 X
3,633,960 A * 1/1972 Drayton ..... 294/82.36 X
4,195,872 A * 4/1980 Skaalen et al. ..... 294/82.19

FOREIGN PATENT DOCUMENTS

SU 1359245 * 12/1987 ..... 294/82.36

* cited by examiner

*Primary Examiner*—Johnny D. Cherry
(74) *Attorney, Agent, or Firm*—Young & Thompson

(57) ABSTRACT

Lifting hook having a control line connected by a resilient and smooth connecting piece to the end of a hook point. The control line is fed through the lifting eye or lifting sling(s) and by then pulling on the line a hook point will be guided by the connecting piece into the lifting eye or lifting sling(s) and hook into the latter.

5 Claims, 10 Drawing Sheets

3
10
9
2
11
8
7
5
4

3
2
21
9
8
19
20
4
5
6

REMOTE OPERATED LIFTING HOOK

BACKGROUND OF THE INVENTION

1. Description of the Invention

The invention relates to a lifting hook wherein a control line is connected by means of a resilient and smooth connecting piece to the end of the hook point.

A lifting hook that is suspended from a crane is widely used for lifting loads. If the load is provided with a fixed lifting eye, the lifting hook is inserted therein. Usually, however, a load is not provided with a lifting eye and one or more short lines or chains, so-called lifting slings, are used to fix the load to the lifting hook. In this case the lifting sling(s) can be linked together on one lifting eye which is placed in the lifting hook, or the lifting sling(s) can be individually placed in the lifting hook. In a number of cases the hook opening is provided with a locking system to prevent undesirable slipping in and out.

For a large proportion of the loads the lifting eye or the lifting sling(s) is/are fitted into the hook opening manually by one or more persons. The locking system, if fitted, is then closed, also manually or automatically, and the crane lifts the load on the hook. Unhooking again takes place manually in the reverse sequence.

Strength and dexterity on the part of the operator are required both for hooking up and for unhooking. In addition, during these operations the operator can be injured, which can occur in diverse ways, for example by limbs becoming trapped, by movements of the hook and the load and by movements of the working platform on which the operator is located.

These problems arise especially in situations where external forces and movements act on the hook, the load, the operator and the working platform. Manual hooking up and unhooking are both made more difficult as a result. This arises, for example, on board ships which are unloading cargo at a (fixed) offshore platform at sea. Because of these risks the operator will usually wait for a suitable moment to hook up or unhook.

In addition, there are also situations where it is difficult or impossible to allow this connection to be made by a person because there is no suitable or safe place for the person. Consequently, the field of application for lifting loads is restricted.

A number of solutions already exist for lifting loads to and from a level far below the working level, which solutions are aimed at lifting pumps and turbines under a liquid level. These applications are directed in particular towards hooking up and make use of a vertical guide line which has been fitted beforehand and which is permanently connected to the load. In contrast to the present invention, an individual guide line is needed for each load.

An example of this is described in EP 0 661 232 A1 (94 85 0232) for lifting a load such as a submersion pump or turbine from a level far below the working level. In this case use is made of a permanently installed guide line permanently connected to the load. Said line must be made of material that does not corrode, e.g. nylon, and must be so thin that no one would consider using it to lift the load. The guide line runs from the point of the hook through the lifting eye on the pump and vertically up again via two guides on the hook.

The patent does describe a line on the hook point but has the following two differences compared with the present invention:

1) The patent describes a slack line with minimal lifting strength with, as an example, nylon as the material. Based on material data for nylon, a line 6 mm in diameter offers a breaking strain of 750 kgf and a line 8 mm in diameter offers a breaking strain of 2080 kgf. The description 'that no one would consider using it to lift a load' indicates a line less than 6 mm in diameter. Based on material data for nylon, a solid circular rod 6 mm in diameter offers flexural resilience (E.I) of 0.15 $N.m^2$. Compared with a solid rod, a plaited rope has a resilience of the order of 5–10%: 0.01 $N.m^2$.

2) In the figures the patent shows a slack connection between the line and the hook point, as can be seen in FIG. 1 and FIG. 2. In FIG. 1 the angle between the line (12, 13) and the hook point (11) is approximately 50 degrees and in FIG. 2 said angle is approximately 0 degrees. The tensile stress in said thin and slack line between the guide(s) and the hook point is essential for guiding the lifting eye into the hook. Without tensile stress, the slack line will not hook the hook point into the lifting eye.

In addition, the system operates only by allowing a line to run vertically downwards from the hook point to the lifting eye and vertically up again to the guides and, from the latter, up to the working floor which is at a higher level. With this arrangement the lifting eye is lifted and hooked up between these two points. This embodiment is therefore usable only for lifting loads far below the working level. The system described does not function for loads which are at the same height as the working level. The specific connecting piece between the line and the hook point of the present invention is, nevertheless, not described.

SUMMARY OF THE INVENTION

The aim is achieved by means of a hook system as described above having the characterizing features discussed below.

The control line can be made of any materials known from the prior art and can comprise either a line, chain or flexible material.

The connecting piece can be made of any materials known from the prior art and can comprise a line, hinged material or flexible material. A connecting piece of short length suffices for the majority of applications, but for a number of applications the connecting piece can also have a length such that a control line is no longer needed.

The resilience of the connecting piece is necessary in order to be able to position the lifting eye well in front of the hook point, both in three coordinates and three rotations. With a slack line the lifting eye will not position well in front of the hook point, as a result of which hooking up is made more difficult.

In addition, the resilience is needed for lifting loads to and from a level at the same height as or above the working level; in this case the lifting eye is lifted, sliding along the line, into the lifting hook. In the case of a slack line the lifting eye will not be lifted up but will remain stuck in front of the hook point.

The resilience of the connecting piece can be constant over the length of the connecting piece but can also decrease from the hook point end to the control line end. For good positioning of the lifting eye in front of the hook point it is necessary for that part of the connecting piece at the hook point end to be resilient; a transition between the slack control line and the rigid hook point is achieved in this way. The resilience of the section of the connecting piece at the control line end can be minimal; the control line itself does not have to have any resilience.

A steel rope with a length of the order of 1 m and a diameter of 10 mm suffices as a connecting piece for a typical lifting hook with a lifting capacity of 75 tonnes BL (failure load) and a weight of 15 kg. This rope corresponds to a minimum resilience expressed as modulus of elasticity multiplied by moment of inertia (E.I) of the order of 0.5 $N.m^2$. The system still functions with half this resilience, but under dynamic loading the lifting eye will hook up less frequently.

The following expression for the resilience of the connecting piece at the hook point is proposed as the lower limit for proper functioning:

EI–(BL^3)/1500000+0.01 where

^3=raise to the power of three

E=modulus of elasticity in ($N.m^{-2}$)

I=moment of inertia ($m^4$)

BL=break load at which hook gives way in (tonf).

The hook shape and hook point can be of any shapes known from the prior art.

In the case of a hook point having a component directed upwards, the lifting eye and/or the lifting sling(s) remain(s) in the hook under the action of gravity; with this arrangement it is possible for a locking mechanism to be fitted. An additional release mechanism is needed for detaching the hook.

In the case of a hook point having a component directed downwards, a locking mechanism or a sunken rim is needed to hold the lifting eye and/or the lifting sling(s) in the hook against the action of gravity. In the case of a locking mechanism, the hook releases on opening the locking mechanism.

According to an advantageous embodiment, the control line is also used to operate the locking mechanism or release mechanism. In this context three embodiments are possible when using a single connecting line:

1) A transverse (sideways) stroke by the control line is used to operate the mechanism. This operation can comprise any systems known from the prior art. According to an advantageous embodiment, a rotary or bending construction is fitted between the hook body and the hook point with the connecting piece and the control line. Turning of the hook point by said 'stroke' triggers the release/locking mechanism, as a result of which the lifting eye and/or lifting sling(s) is/are able to unhook.

2) An axial constant loading is used to operate the mechanism. This operation can comprise any systems known from the prior art. According to an advantageous embodiment, the control line is connected by means of the connecting piece to a pivoting dog, which rotates as a result of the tensile force of the control line and triggers the release/locking mechanism.

3) An axial jerk on the control line is used to operate the mechanism. This operation can comprise any system known from the prior art. According to an advantageous embodiment, the control line is connected by means of the connecting piece to a pivoting dog, which rotates as a result of the axial jerk on the line and triggers the release/locking mechanism.

In addition, there are also a number of possibilities for multiple control lines, it being possible for the above possibilities for the single control line to be combined. A particular embodiment of this is an inner line and an outer line, a so-called 'Bowden' line. By this means it is possible to exert not only tensile force but also compressive force by means o; the inner line. This embodiment is outstandingly suitable for implementation of a highly reliable operation of the release/locking mechanism, which operation takes place only by means of, for example, a combination of tensile force on the outer line and compressive force on the inner line. The likelihood of this combination of interplay of forces in response to external forces is slight.

According to a further advantageous embodiment, a rope loop is fitted through the lifting eye and/or the lifting sling(s) beforehand. This rope loop is then connected to the control line at the hook point and, by pulling round the rope loop, the control line is guided through the lifting eye and/or lifting sling(s). This embodiment makes it possible for a person to be able to feed the control line through the lifting eye and/or lifting sling(s) even from some distance away.

According to a further advantageous embodiment, the hook construction is such that the release/locking mechanism cannot be operated when the hook is under load.

BRIEF DESCRIPTION OF THE DRAWINGS

The invention will be explained in more detail below with reference to the illustrative embodiments shown in the drawings.

DETAILED DESCRIPTION OF THE PREFERRED EMBODIMENTS

Figure 1:
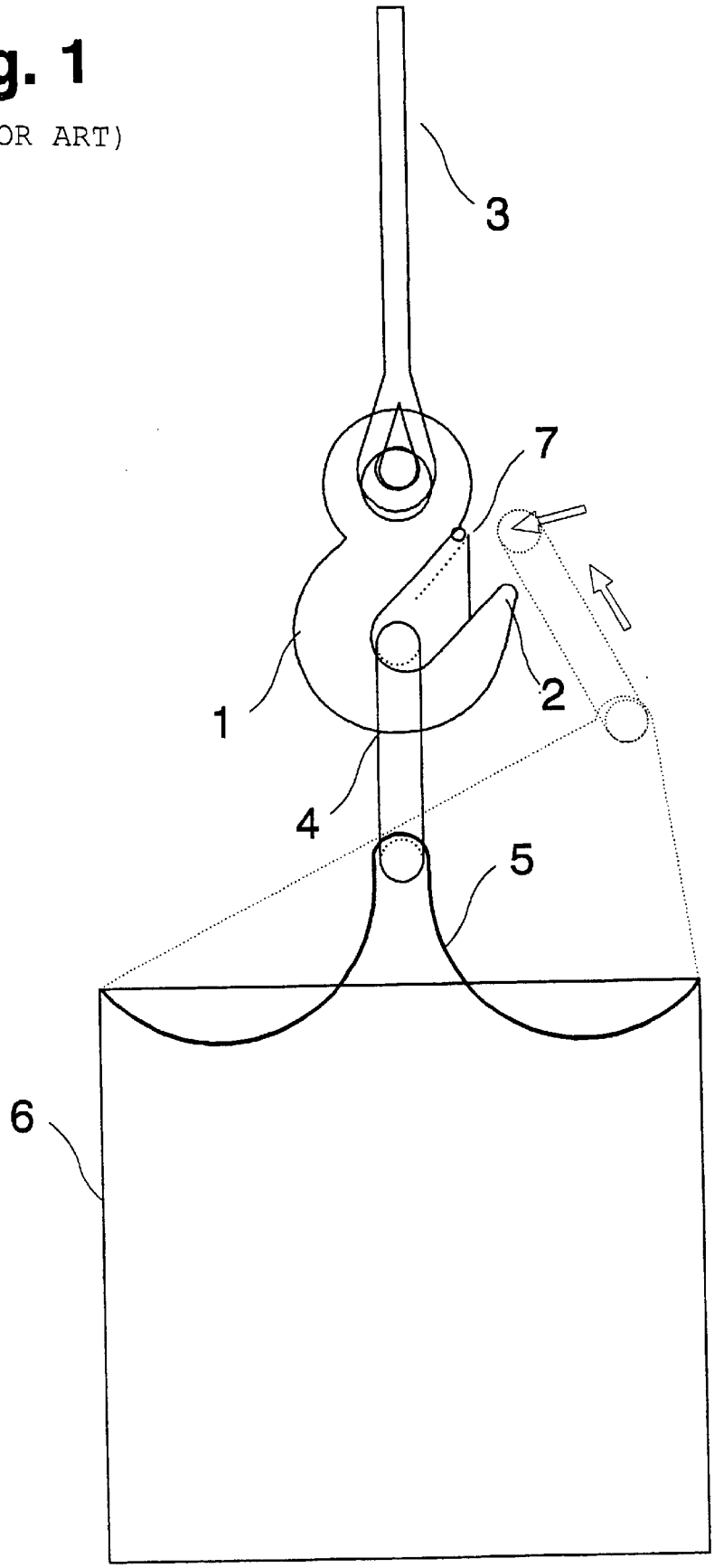
Fig. 1 (PRIOR ART)
FIG. 1 shows, diagrammatically, a side view of a standard lifting situation.

FIG. 1 shows a standard lifting situation with a lifting hook 1 provided with a hook point 2 and possibly a safety catch 7, a lifting line 3, an oval lifting eye 4, a load 6 and a two-leg lifting sling 5. Hooking up is effected by manually lifting the lifting eye over the point of the lifting hook into the lifting hook, after which the safety device is closed. Unhooking is effected by opening the safety device and by again lifting the lifting eye manually over the point of the lifting hook.

Figure 2:
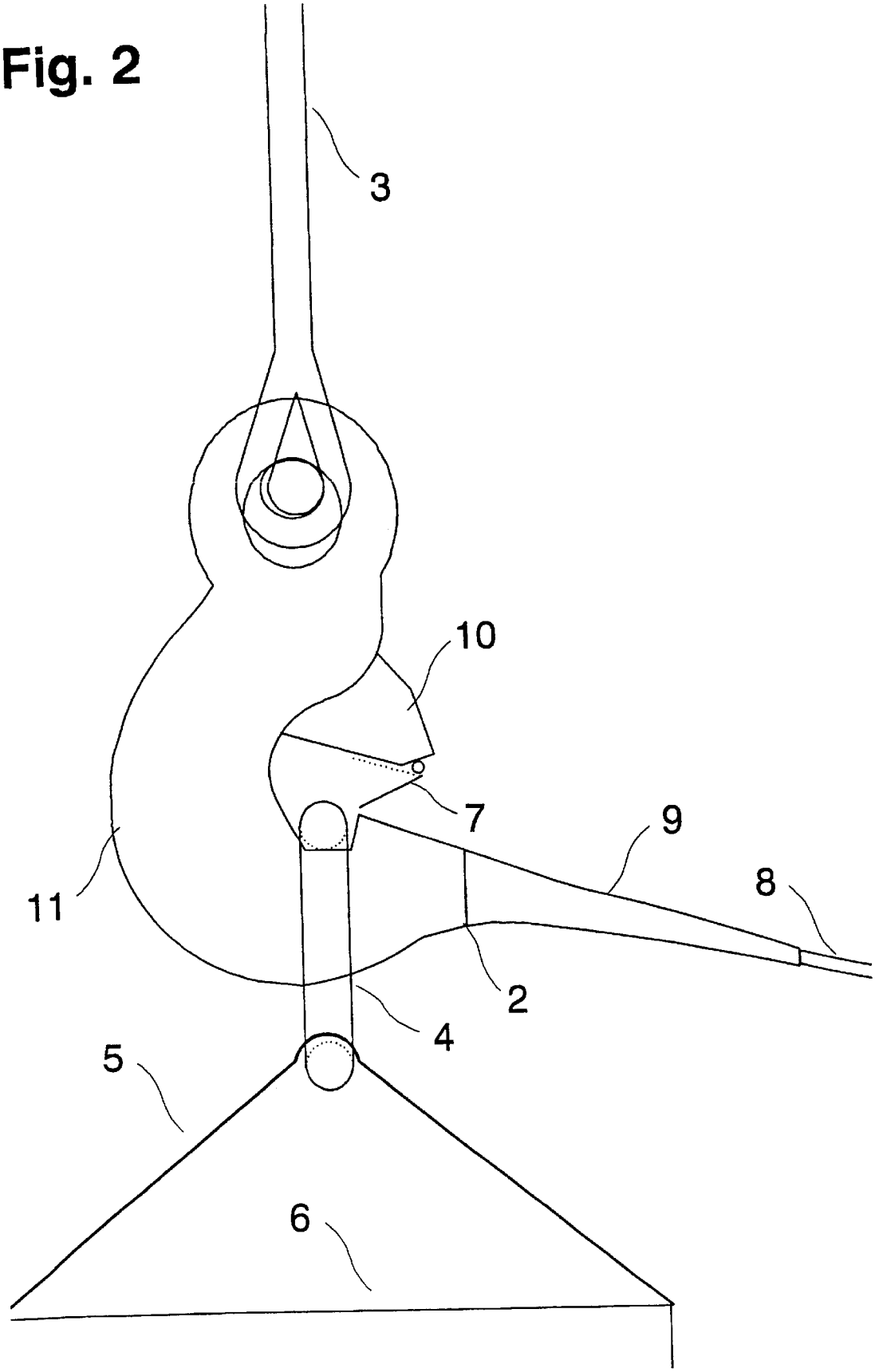
FIG. 2 shows, diagrammatically, a side view of a first embodiment of the lifting hook according to the present invention.

FIG. 2 shows the first embodiment of the lifting hook with a lifting hook 11 provided with a hook point 2 and possibly a safety catch 7, a connecting piece 9 on said hook point and a control line 8. A filler plate 10 is fitted in the hook opening. Furthermore, an oval lifting eye 4, a load 6 and a 2-leg lifting sling 5 are again shown.

Figures 3, 4, 5:
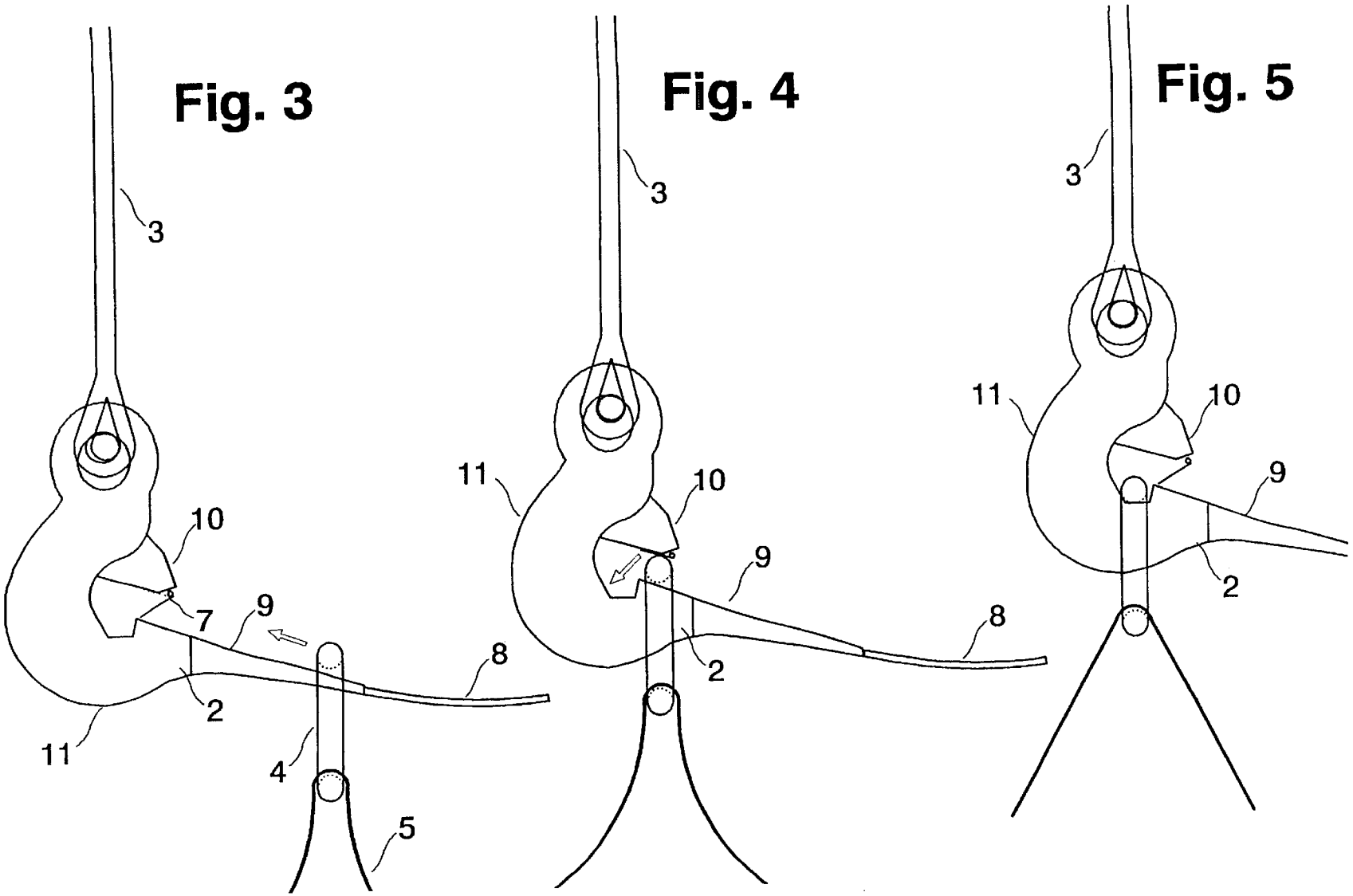
FIGS. 3–5 show the steps for hooking up the lifting eye in the hook opening.

In FIG. 3 the control line 8 has been passed through the lifting eye 4 and a pull is exerted on said line. The hook follows the control line by means of the connecting piece. As a result of the resilience of the connecting piece, the lifting eye is lifted up and the lifting eye and the hook point are simply and efficiently guided into the proper position for hooking up.

In FIG. 4 the lifting eye 4 has been slid over the hook point 2 by means of the connecting piece 9.

In FIG. 5 the lifting eye slides down over the rim into the hook opening and the load can now be lifted. In this embodiment of the lifting hook, unhooking still has to be carried out manually.

Figure 6:
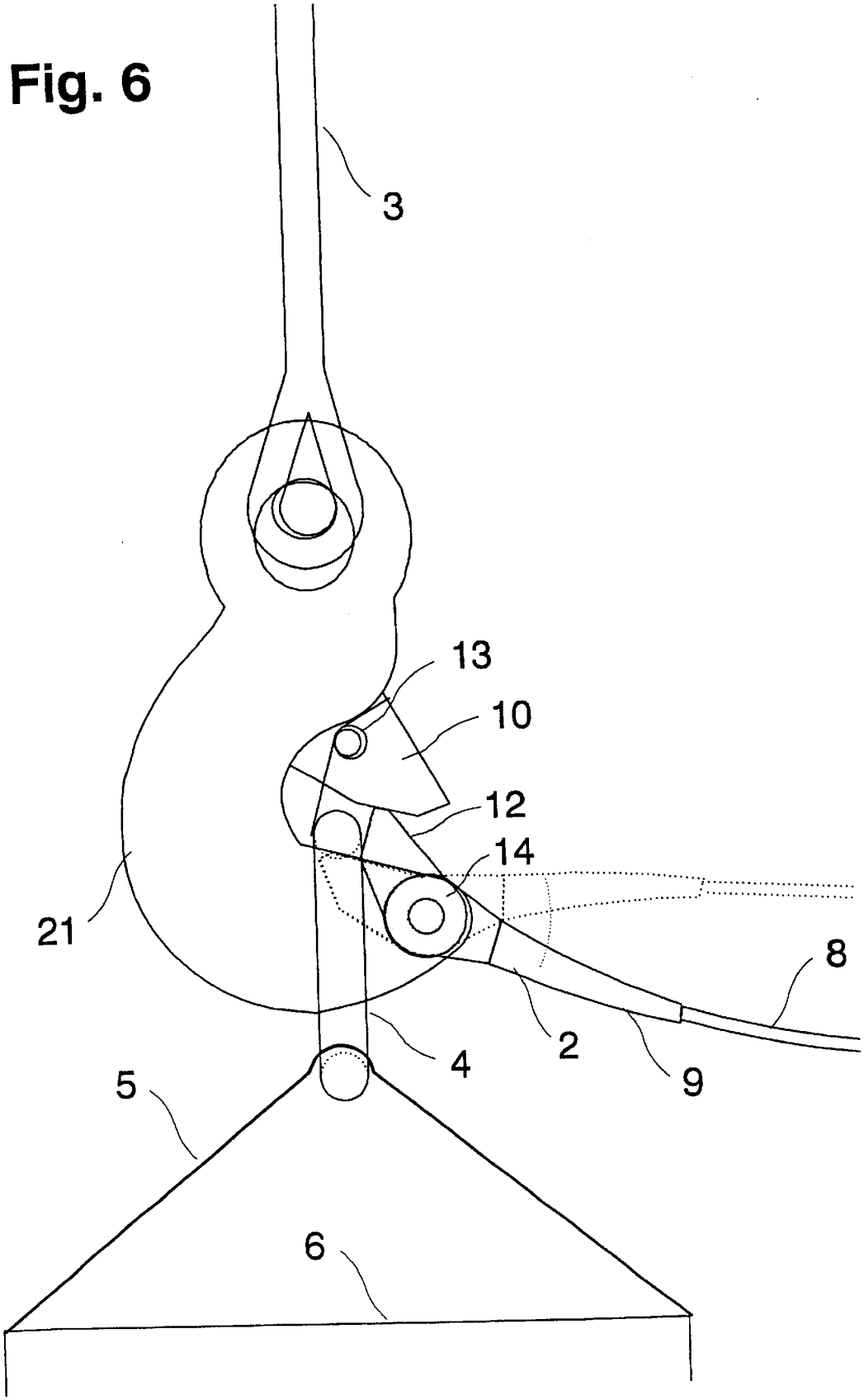
FIG. 6 shows, diagrammatically, a side view of a second embodiment of the lifting hook with a pivoting dog having a hook point having a component directed downwards.

FIG. 6 shows a second embodiment of the lifting hook with a lifting hook 21 provided with a hook point 2 having a component directed downwards, an internal dog 12 which is permanently connected thereto and pivots on a hinge 14, a control line 8 connected to said hook point by means of a connecting piece 9, a filler plate 10 in the hook opening and a spring 13. Furthermore, an oval lifting eye 4, a load 6 and a 2-leg lifting sling 5 are again shown.

On hooking up, the lifting eye slides by means of the connecting piece over the hook point 2 and the hook point and the dog connected thereto pivot about the hinge 14. The lifting eye presses against the spring 13. The hook point plus the dog then rotate back about the hinge again and the exit for the lifting eye is blocked. The spring 13 presses the lifting eye against the dog. The load can now be lifted.

On unhooking (in the unloaded state), an upward transverse stroke is applied to the control line 8. As a result the hook point and dog rotate about the hinge and the spring 13 pushes the lifting eye out of the hook (condition shown in dotted lines).

Figure 7:
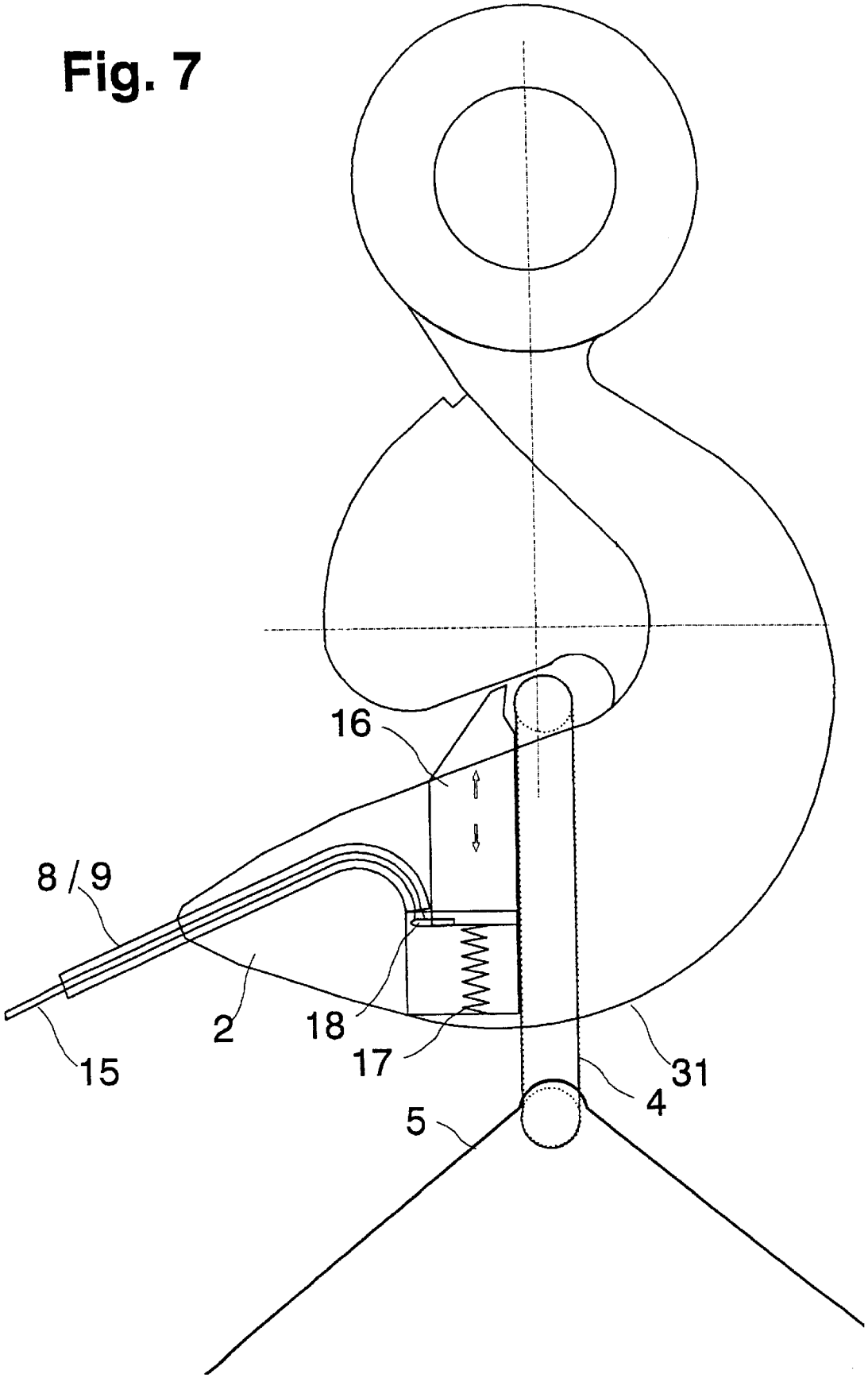
FIGS. 7 and 8 show, diagrammatically, the cross-section of the embodiment of the lifting hook of the present invention with a control line provided with an inner and an outer line (Bowden line).

In FIG. 7 the hook 31 with a connecting piece consisting of a double control line is shown with an outer line 8, an inner line 15, a sliding dog 16 and a spring 17 in the closed position. The outer line is firmly connected to the hook, but the inner line is able to move freely through the outer line and pushes against a flanged end 18 of the sliding dog. The dog is pushed upwards by the spring 17 and blocks the opening of the lifting hook. The sliding dog has a sloping surface so that the lifting eye moves the dog downwards when the hook opening is pulled into the eye. The inner line does not also move during this movement. In this embodiment the control line is smoothly connected to the hook point and the double control line has an appreciable resilience, as a result of which said line takes over the function of the connecting piece.

Figure 8:
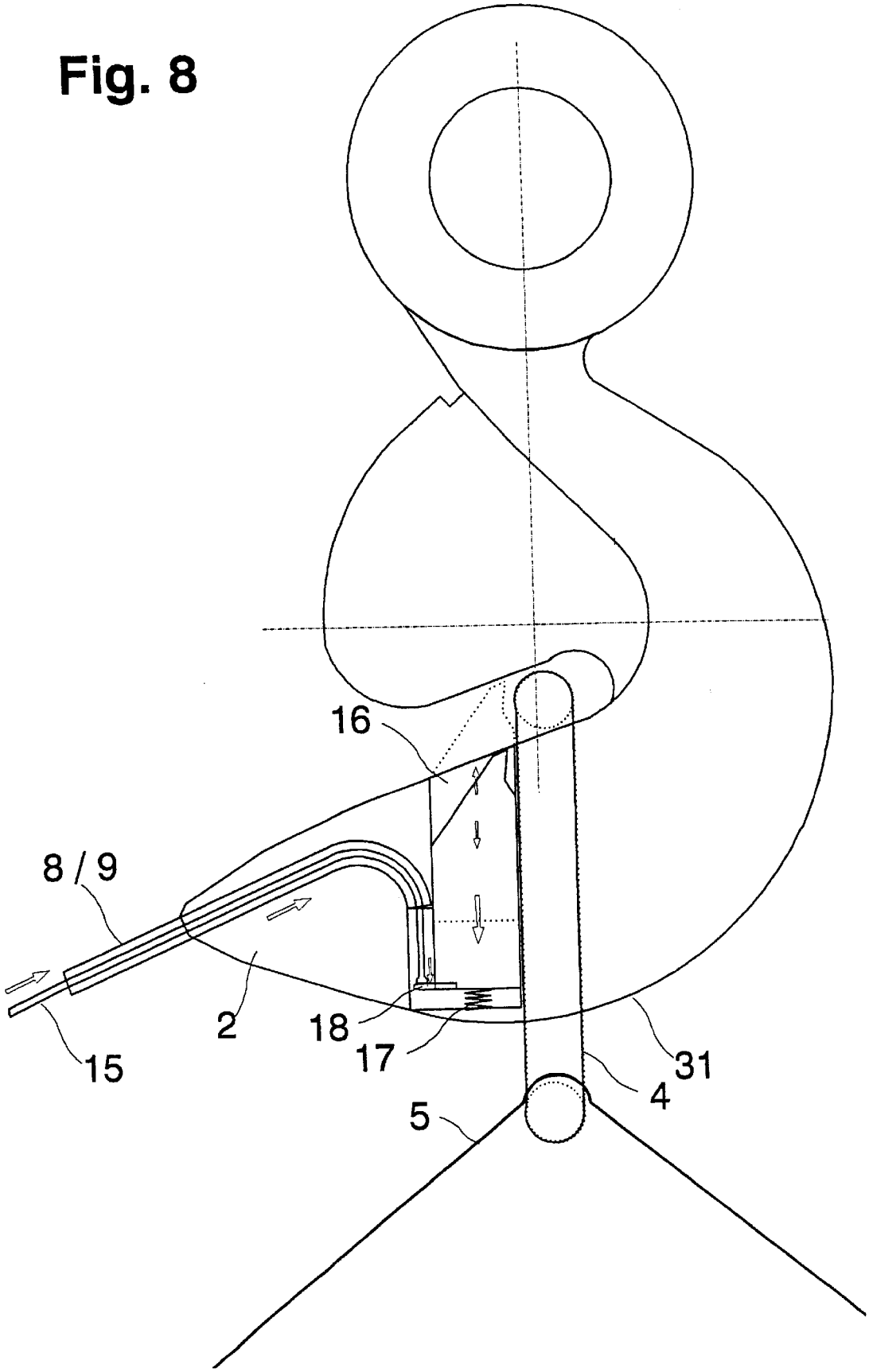

In FIG. 8 the above hook 31 is shown in the open position. By pulling on the outer line 8 and pushing the inner line 15 the inner line pushes the sliding dog 16 downwards, via the flanged end 18, against the resilience of spring 17. As a result the lifting eye 4 is able to slide out of the hook.

Figures 9, 10, 11:
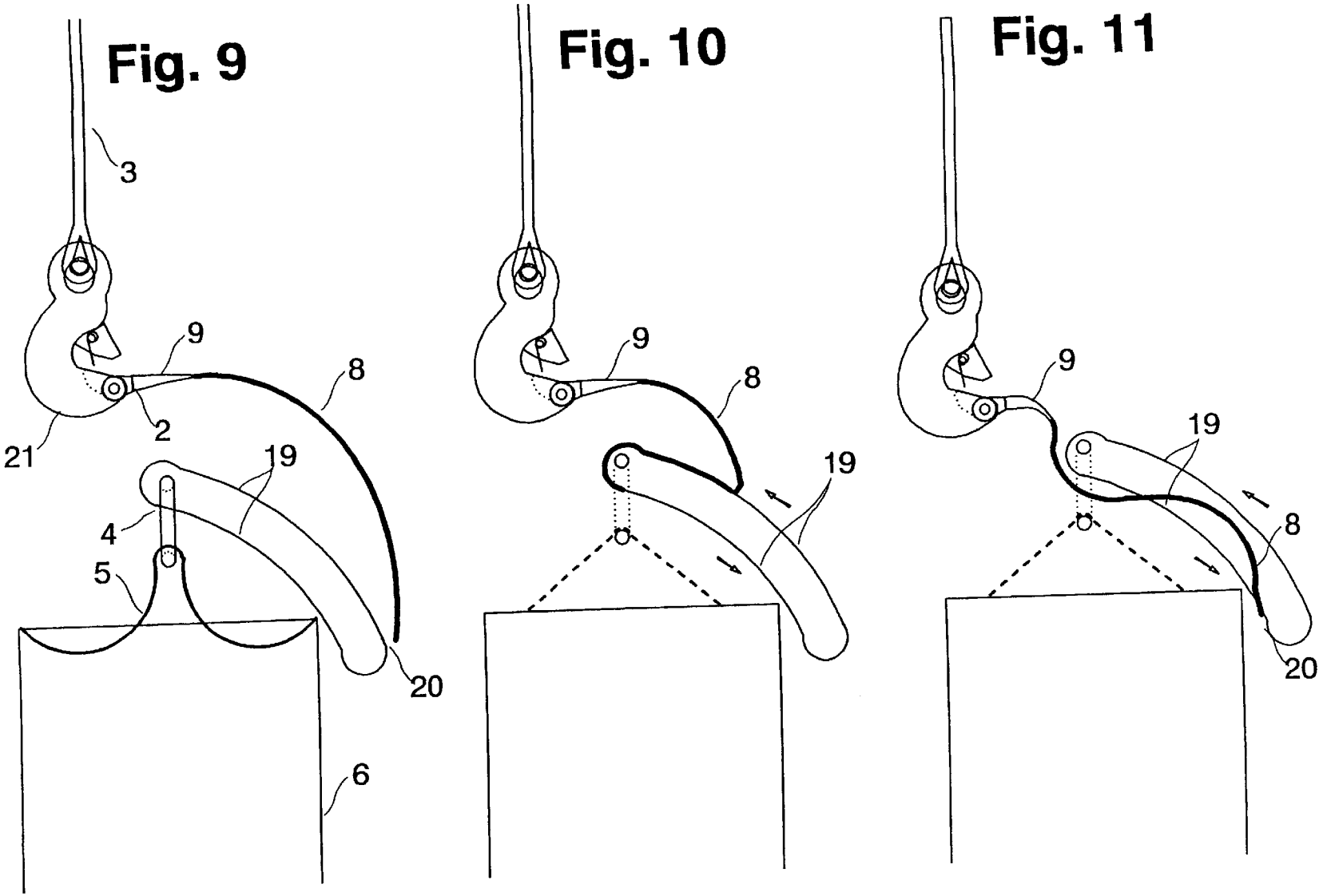
FIGS. 9–11 show, diagrammatically, a rope loop through the lifting eye and/or lifting sling(s) and the steps for pulling the control line round and then hooking up. Unhooking takes place in the reverse sequence.

The second hook 21 is shown again in FIG. 9. In this case a rope loop 19 has been fed through the lifting eye beforehand and this rope loop hangs at the side of the load. The rope loop is fixed to the control line 8 by means of a coupling piece 20 and the rope loop is then pulled round.

The following stage is shown in FIG. 10 and the control line is pulled through the lifting eye 4 by the rope loop.

FIG. 11 shows the final stage in pulling round; the control line is again back at the side of the load and can now be used to make the lifting hook hook into the lifting eye. If desired, the coupling piece 20 can be detached. By means of this embodiment it is possible to make the lifting connection remotely. The drawing is diagrammatic with small distances, but operation is also possible with the load at greater distances away. In addition, the rope loop can also be used to attach the load to objects in order to prevent movement of the load.

Figure 12:
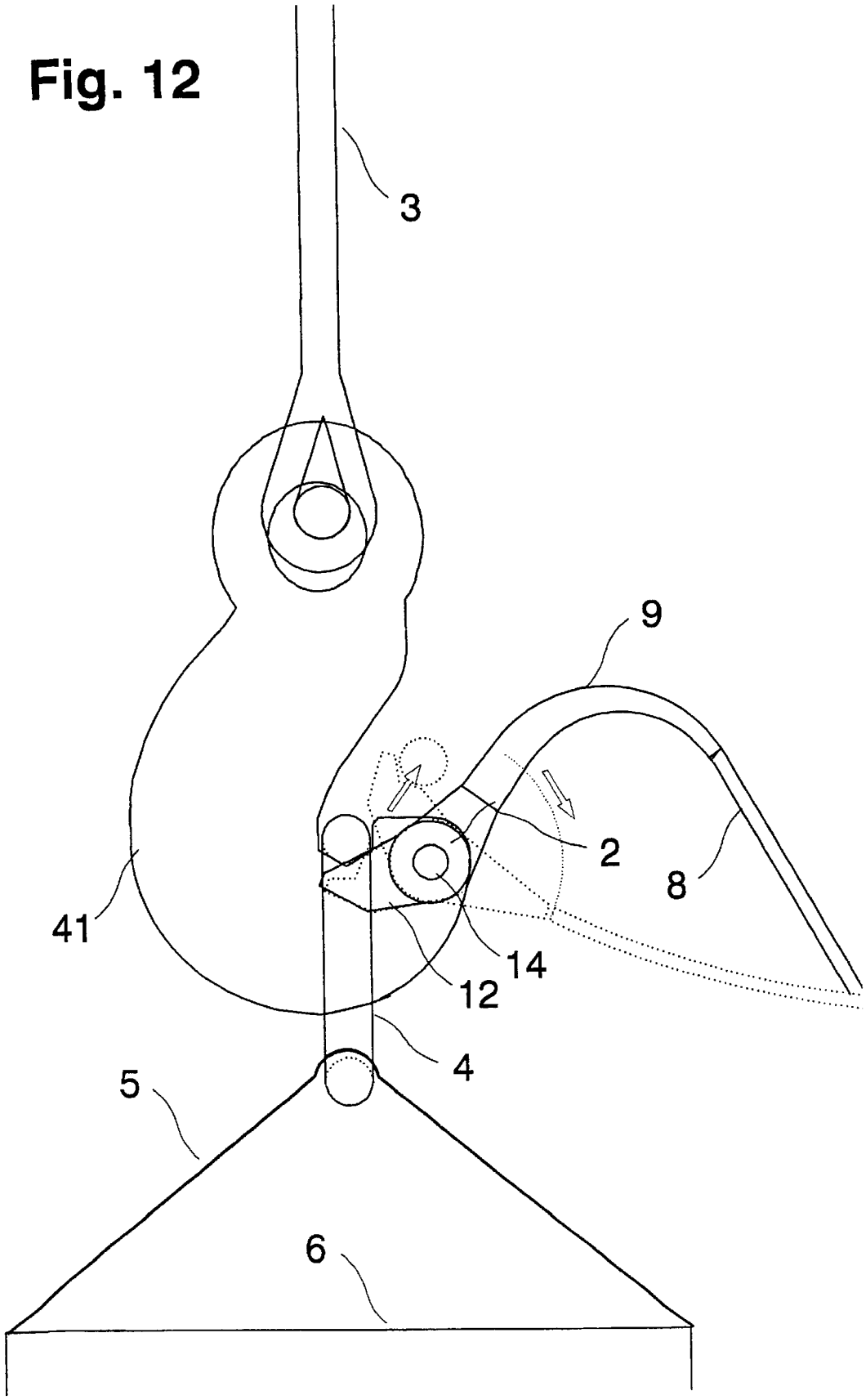
FIG. 12 shows, diagrammatically, a side view of the lifting hook according to the present invention with a hook point having a component directed upwards.

FIG. 12 shows a hook 41 with a hook point 2 having a component directed upwards, an internal dog which is permanently connected thereto and pivots on a hinge 14 and a control line 8 on the hook point. Furthermore, an oval lifting eye 4, a load 6 and a two-leg lifting sling 5 are again shown. Hooking up takes place as shown in FIGS. 3–5. Unhooking takes place either by giving a transverse downward stroke or by pulling the control line downwards, as a result of which the lifting eye is lifted and is propelled out of the hook.

Figure 13:
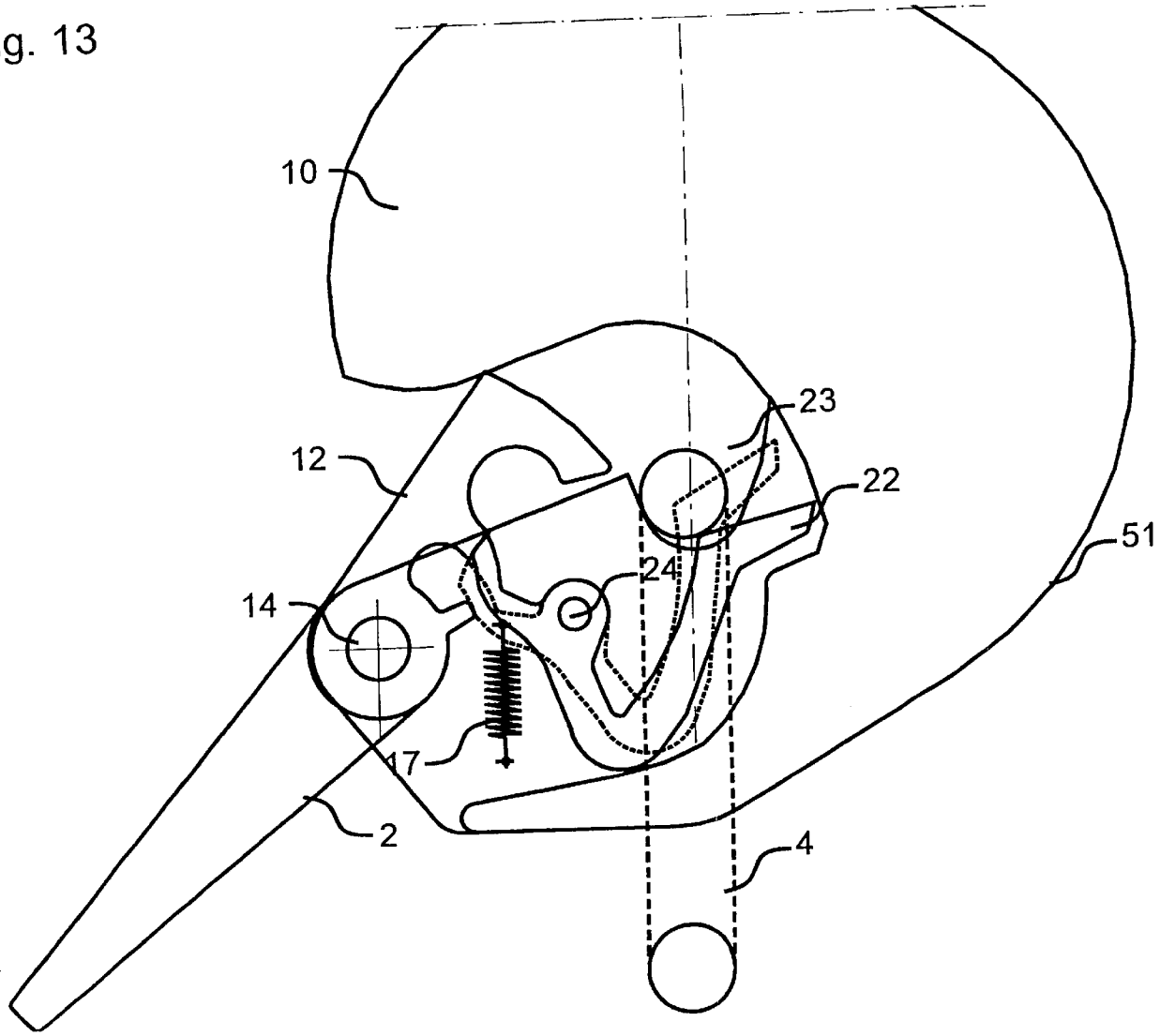
FIG. 13 shows, diagrammatically, the cross-section of the embodiment of the locking mechanism that cannot be operated under load, in combination with a release mechanism.

FIG. 13 shows a lifting hook 51 provided with a hook point 2 having a component directed downwards; on hooking up, the lifting eye 4 moves upwards over the hook point and then down again into the hook opening 23. The hook point 2 is permanently connected to dog 12 and pivots on hinge 14. A locking dog 22, pivoting on hinge 24 and connected to a spring 17, is also shown. As soon as the lifting eye 4 is placed under load, the lifting hook presses on the locking dog 22, which rotates against the resilience of spring 17 and thus prevents rotation of dog 12. As soon as the loading decreases, the locking dog 22 rotates back as a result of the resilience and dog 12 is again able to rotate freely in response to a transverse stroke with the control line.

Figure 14B:
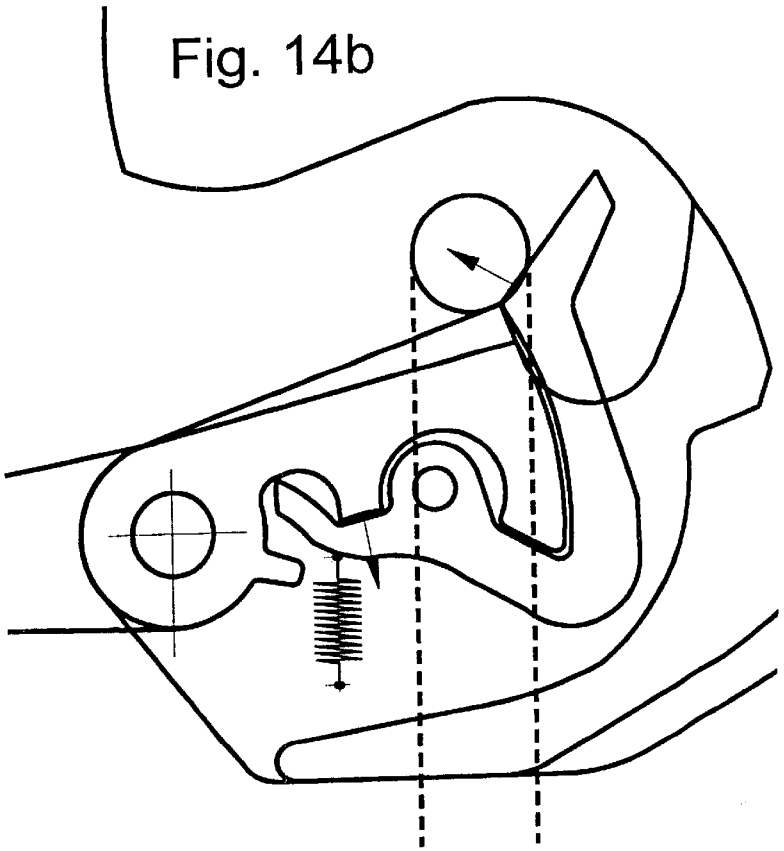
FIGS. 14*a* and 14*b* show the release mechanism of this embodiment.
Figure 14A:
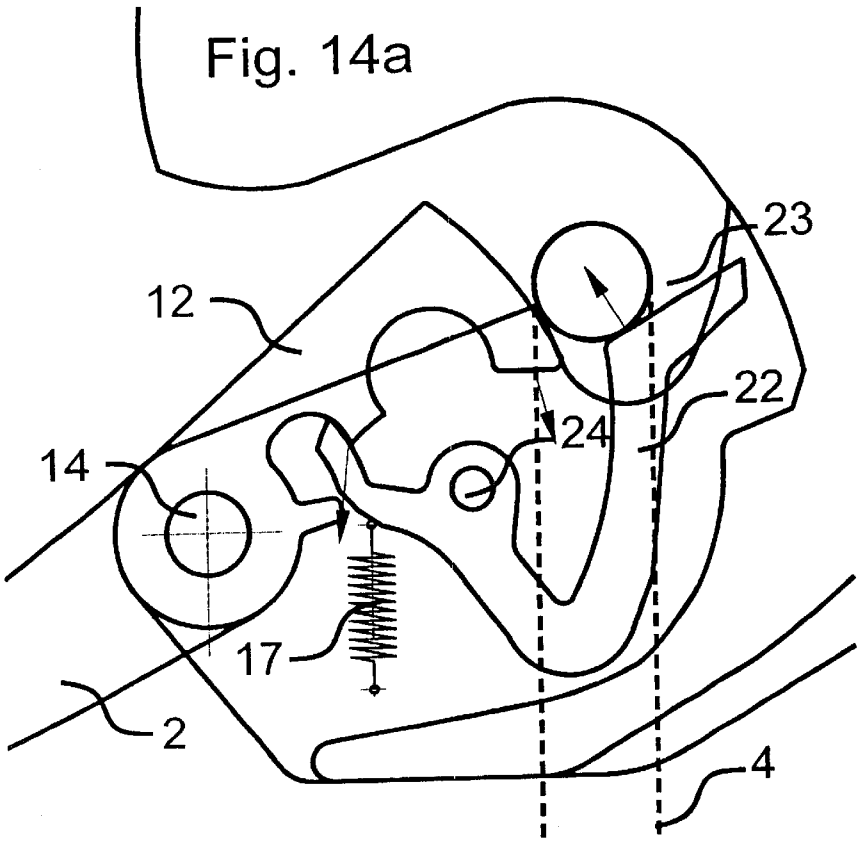

The release mechanism is shown in FIGS. 14*a* and 14*b*. As soon as the loading on the locking dog 22 decreases, dog 12 is able to rotate in response to a stroke movement. The stroke movement of dog 12 rotates the locking dog 22, as a result of which the lifting eye 4 is lifted up from the hook opening 23 and is propelled out of the hook opening at the same time. When dog 12 rotates back, the lifting eye is lifted and guided out of the hook opening.

Although the invention has been described above with reference to a number of preferred embodiments, numerous modifications can be made without going beyond the scope of the present application. The system can be used in many types of locations where loads are lifted using hooks, both under favourable and under relatively adverse external conditions.

In addition the system is not restricted to the lifting hook connected to the crane and the lifting eye and/or the lifting sling(s) on the load, but it is also possible to reverse the system and to connect the lifting eye and/or lifting sling(s) to the crane and the lifting hook to the load or to use the system in a direction with a horizontal component.

What is claimed is:

1. A hook system for lifting loads, comprising:

a hook connected to a line;

a hook point provided on said hook;

a connecting piece connected to said hook point and to a further line;

said connecting piece comprising a transition portion located between said further line and a part of the hook which directly adjoins said hook point, the transition portion being continuous and resilient, having a minimum resilience in accordance with the expression:

$$EI-(BL\hat{}3)/1500000+0.01$$

where

ˆ3=raise to the power of three

E=modulus of elasticity in ($N.m^2$)

I=moment of inertia ($m^4$)

BL=break load at which hook gives way in (tonf).

2. Hook system according to claim 1, wherein the connecting piece is constructed so that the transition portion has a smooth shape.

3. Hook system according to claim 1, wherein said hook is connected to a crane and to a load via a lifting eye and sling.

4. Hook system according to claim 1, further comprising a lifting eye connected to a crane and, wherein the hook is connected to a load.

5. Hook system according to claim 1, further comprising a lifting sling connected to a crane and, wherein the hook is connected to a load.

* * * * *